US005228220A

United States Patent [19]

Bryan, Jr.

[11] Patent Number: 5,228,220

[45] Date of Patent: Jul. 20, 1993

[54] BUCKET CHAIN EXCAVATOR

[76] Inventor: John F. Bryan, Jr., 4250 W. Lovers La., Dallas, Tex. 75209

[21] Appl. No.: 811,924

[22] Filed: Dec. 23, 1991

Related U.S. Application Data

[63] Continuation-in-part of Ser. No. 680,512, Apr. 4, 1991, abandoned, which is a continuation of Ser. No. 549,132, Jul. 6, 1990, abandoned.

[51] Int. Cl.[5] ..... E02F 5/06

[52] U.S. Cl. ..... 37/364; 37/359; 37/360; 37/96; 37/97; 37/190; 37/464; 299/36

[58] Field of Search ..... 37/80 A, 86, 87, 89, 37/94, 95, 96, 190, 191 A, 192 R, 192 A; 299/36

[56] References Cited

U.S. PATENT DOCUMENTS

| | | | |
|---|---|---|---|
| 912,937 | 2/1909 | Embleton | 37/80 A |
| 1,143,897 | 6/1915 | Flexner | 37/190 |
| 1,210,412 | 1/1917 | Budlong | 37/80 A |
| 1,283,383 | 10/1918 | Webster | 37/192 R |
| 1,455,206 | 5/1923 | Howe et al. | 37/80 A |
| 1,472,562 | 10/1923 | Knight | 37/192 R |
| 3,897,109 | 7/1975 | Satterwhite | 299/39 |
| 3,974,580 | 8/1976 | Satterwhite | 37/189 |
| 3,982,340 | 9/1976 | Satterwhite | 37/190 |
| 3,982,341 | 9/1976 | Satterwhite | 37/190 |
| 3,987,564 | 10/1976 | Satterwhite | 37/190 |
| 3,997,990 | 12/1976 | Satterwhite | 37/189 |
| 4,003,148 | 1/1977 | Satterwhite | 37/190 |
| 4,030,217 | 6/1977 | Satterwhite | 37/190 |
| 4,063,375 | 12/1977 | Satterwhite | 37/190 |
| 4,069,605 | 1/1978 | Satterwhite | 37/190 |
| 4,785,560 | 11/1988 | Hanson | 37/96 R |
| 4,955,151 | 9/1990 | Bryan | 37/190 |
| 5,058,294 | 10/1991 | Bryan | 37/94 X |

*Primary Examiner*—Dennis L. Taylor
*Assistant Examiner*—Arlen L. Olsen
*Attorney, Agent, or Firm*—John F. Bryan, Jr.

[57] ABSTRACT

A continuous excavating and loading machine having a front mounted rotary digging element divided into sections to allow cantilevered support, digs a width greater than that of any other part of the machine so that the machine may advance on the surface it has cut. The digging element is driven by digging chains which also break up material in their path so that the full digging face is excavated. Excavated material is discharged outwardly from the digging element by both centrifugal force and gravity after rotation past top center. The excavated material falls onto a conveyor system to be elevated and transported to the rear of the machine for transfer to appropriate carriers. A moldboard blade trims surface irregularities and pushes passed material forward into the bucket wheel. A movable skid plate, held against the cut surface by a constant force, supports digging torque reaction loads and damping is provided for shock conditions.

26 Claims, 8 Drawing Sheets

BUCKET CHAIN EXCAVATOR

This is a continuation in part of application Ser. No. 680,512, filed Apr. 4, 1991, now abandoned, which is a continuation of application Ser. No. 549,132 filed Jul. 6, 1990, now abandoned.

FIELD OF THE INVENTION

The invention pertains to continuous mobile excavating and loading machines having a forward mounted rotary digging element may be wider than the undercarriage or other part of the machine, thus enabling the machine to advance along the excavated bottom. The invention includes digging element drive chains which also serve to dig a portion of the excavation width. The digging element may be embodied as spaced apart buckets carried between the drive chains or may be a bucket wheel.

BACKGROUND AND SUMMARY

Bucket wheel excavators, as typified by conventional wheel ditching machines and strip mine excavating machines where the bucket wheel is carried on a boom, have historically employed a passive, gravity discharge method. This method drops the discharging material toward the center of the wheel as each bucket reaches the top of its rotation by uncovering an opening in the inward wall, or back, of the bucket. The material then falls onto a conveyor at the interior of the wheel and is carried away. The nature of this discharging action, wherein gravity overcomes centrifugal force, favors relatively large diameter digging wheels which turn at lower rotational speeds. Any desired cutting speed can be achieved at a relatively low rotational speed by increasing wheel diameter, thereby reducing the influence of centrifugal force on the material being discharged.

Recent years have seen the advent of another form of bucket wheel excavator as disclosed in Satterwhite U.S. Pat. No. 3,896,571, wherein closely spaced bucket wheel sections are closely and rigidly coupled to the main frame of the machine. This later type discharges material outwardly, well after the bucket passes the top of its rotation In these machines, the bucket assemblies are again an integral part of the wheel structure, with their volume defined by the wheel sides and three surfaces referred to as the back, bottom, and lip. The lip includes a cutting edge, and is set at a shallow angle to the periphery of the wheel, providing an entry ramp for material into the bucket. The bucket bottom is fixed in position and the bucket back pivots on an axis located behind the lip of the leading adjacent bucket. The bucket back is moved by a pushrod which works on a cam roller near the wheel center so as to push material from the bucket in a positive manner at the appropriate angle of wheel rotation.

The bucket back displaces material outwardly so that, on the downward travel of the bucket, gravity causes the material to slide down and to the outside. Conveyors are located just outside the arc of the wheel, at a height that is necessarily below that of the wheel center, so as to catch the discharge and carry it off. In practice the optimum height of this discharge point has been found to be at an elevation of approximately one-third of the diameter of the digging wheel. It is necessary, however, to maintain a sufficient digging wheel size to allow physical room for a conveyor system to fit under its discharge without ground interference, and this larger diameter tends to reduce the centrifugal forces related to discharge. In any case, the influence of centrifugal force assists, or at least does not oppose, the discharge of material in this type bucket wheel excavator, as it did with the earlier type machines. In practice, the belt conveyor length needed to carry material to an elevated rear transfer point determines the overall machine length in that, if material is received at a lower point, the machine becomes consequently longer. The bucket discharge elevation issue has been addressed more recently by an articulated bucket design which raises discharge to the height of the wheel center at the expense of greater complexity.

The drive for rotating the bucket wheel sections is accomplished by means of reduction gearing which is internally mounted within the confines of the wheel assemblies and is thus difficult to inspect and maintain. This forward concentration of mass also tends to make the machine front-heavy, so that a counterbalancing rear overhang is needed to distribute undercarriage loading.

A significant aspect of these excavators is a capability for excavating harder formations than is possible with the boom mounted bucket wheels. This capability is attributable to the chatter-free presentation of cutting edges to the work face and to the higher cutting forces which can be applied with a close-coupled machine configuration.

An object of the present invention is therefore to achieve the potential of close-coupled, rigidly supported cutting edges while avoiding the penalties of unnecessary size, weight and complexity. This calls for excavating means with an elevated discharge height and elimination of the complexity of articulated buckets. A related object is to provide a more accessible drive for this excavating means and moderate the forward weight bias by moving this drive rearward.

The present invention accomplishes these objects with an excavating machine having closely spaced digging chain assemblies rigidly supported by the main frame at the front of the machine. These chain assemblies include large capacity, multiple pitch, transverse buckets which are adapted to accommodate chain wear and to conform to varying chordal dimensions as the digging chains pass through straight runs and around the upper driving sprockets and lower digging sprockets, which may be toothed or not. The digging sprockets are of sufficient diameter to provide rigid support to the chains along the depth of the work face. The driving sprockets are positioned above and behind the digging sprockets so that material is discharged outwardly from the chain path by both gravitational and centrifugal forces as the buckets pass over the driving sprockets.

The driving sprockets are preferably smaller in diameter than the digging sprockets so as to limit the overall height of the machine and enhance the centrifugal discharge effect. In effect, this relatively smaller diameter also provides a drive line reduction stage. Power input to the driving sprockets may be accomplished by various hydraulic, electrical or mechanical means, but in any case, the mass thereof is moved significantly toward the rear of the machine.

A moldboard blade trims material left between the bucket chain assemblies so as to smooth the cut surface and a skid plate immediately behind the moldboard blade bears against the cut surface to react and support the cutting loads of the bucket chain.

In an alternate embodiment, particularly suited to bucket excavators configured for an elevated bucket discharge, a bucket wheel assembly is carried on frame extensions between the closely spaced sections, as in prior practice. In this embodiment these spaces also accomodate digging sprockets which rotate the bucket wheel assembly. As with the bucket chain embodiment, the chains driving these sprockets take the form of digging chains which break up the material standing in their path so that this material falls into the adjacent buckets. Thus, the width of the space between bucket wheel sections is not critical to excavator performance.

The grade cut by the subject invention in all embodiments can be defined and controlled in the manner taught by Bryan U.S. Pat. No. 5,058,294, the contents of which are hereby incorporated in this application by reference.

DETAILED DESCRIPTION OF THE INVENTION

Figure 1:
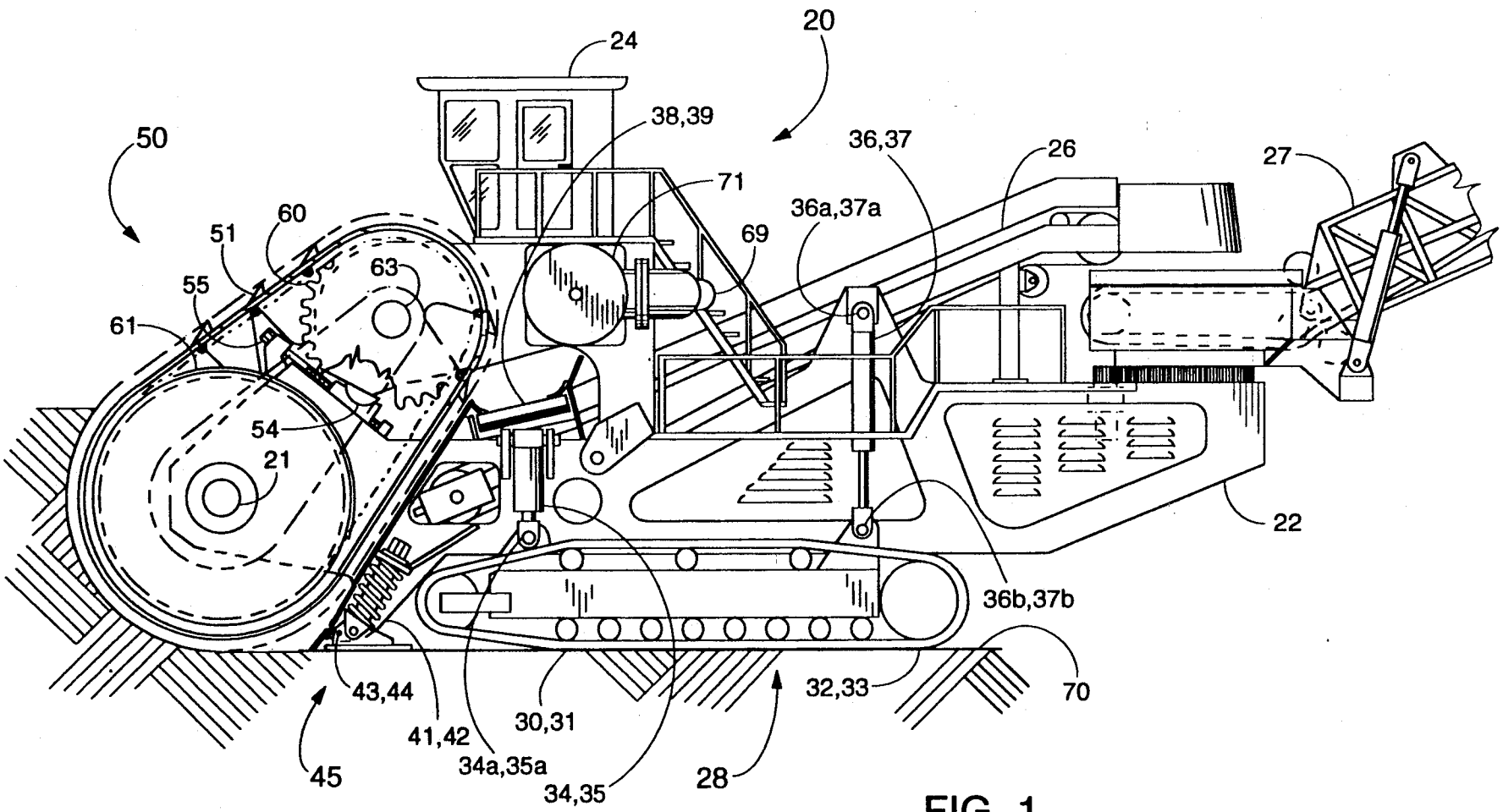
FIG. 1 shows a side view of an excavating machine incorporating a preferred embodiment of the invention.
Figure 2:
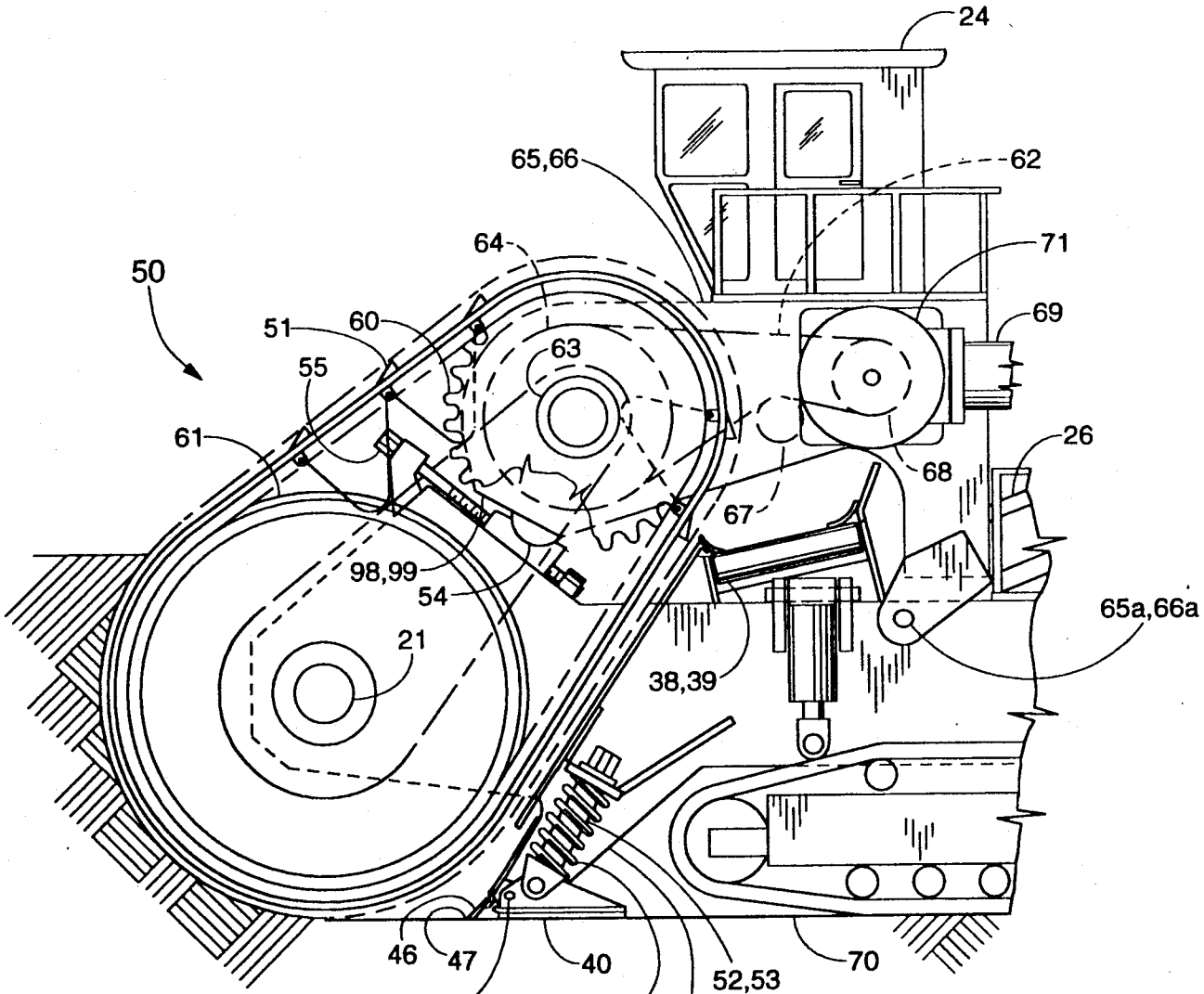
FIG. 2 shows an enlarged detail view of portions of FIG. 1.
Figure 3:
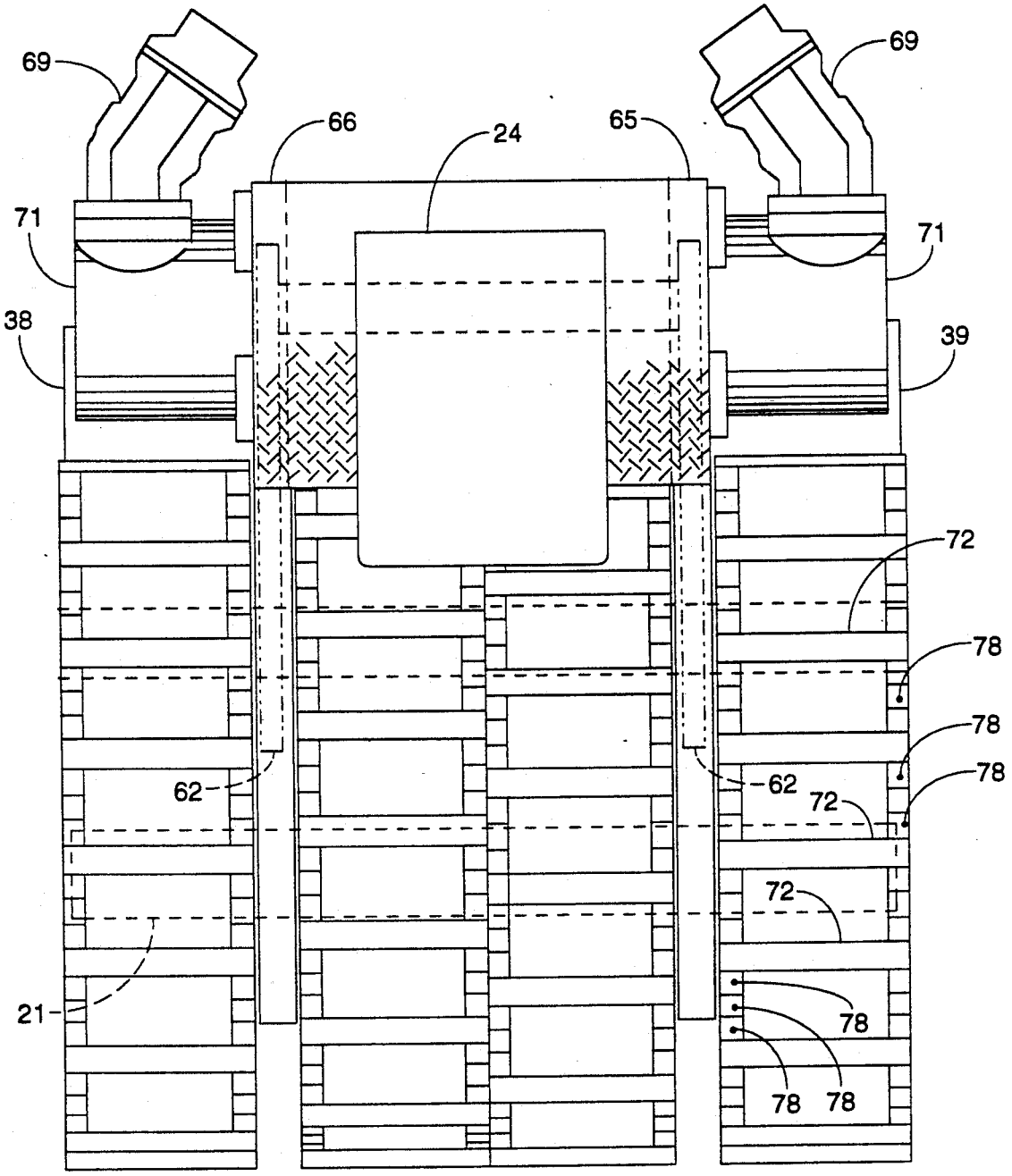
FIG. 3 shows a plan view of the subject matter of FIG. 2.

Referring now to the drawings, and particularly to FIGS. 1-3, a preferred embodiment of the excavating and loading system 20 incorporating the present invention is shown. The system 20 comprises a vehicle main frame 22 with operator cab 24 mounted thereon and bucket chain assemblies 50 mounted to the front end thereof. System 20 is supported and moves on crawler track undercarriage 28 having right and left forward ground contact points 30 and 31 and right and left rear ground contact points 32 and 33, undercarriage 28 being attached to the main frame 22 for verticle movement by means of right and left front hydraulic cylinders 34 and 35 and right and left rear hydraulic cylinders 36 and 37, front hydraulic cylinders 34 and 35 are fixed rigidly to the main frame 22 so that the right and left pivotal connections 34*a* and 35*a* to undercarriage 28 are constrained to move linearly with respect to the main frame 22, and are shown in the retracted position. The pivotal connections 34*a* and 35*a* are located forward of the forward ground contact points 30 and 31. Driving forces are transmitted from the crawler track undercarriage 28 to the main frame 22 through the rigid connection of the cylinders 34 and 35 thereto. The rear cylinders 36 and 37 have pivotal connections 36*a* and 37*a* respectively to the main frame 22 and pivotal connections 36*b* and 37*b* respectively to the undercarriage 28.

Right and left moldboard bolsters 41 and 42 extend from main frame 22 and support moldboard assembly 45 with moldboard blade 46 and cutting edge 47 in a single working position. The skid plate 40 is mounted to the lower end of right and left bolsters 41 and 42 by right and left pivotal connections 43 and 44 and is urged into contact with the underlying cut surface 70 by right and left compression springs 48 and 49. Travel of skid plate 40 is limited by the geometry of the pivotal connections 43 and 44 to an angular range sufficient to maintain contact with cut surface 70 under all conditions of up and down grade transitions, and to allow for compaction of the underlying material. The moldboard blade 46 serves to trim material not cut by bucket chain assemblies 50 and to smooth, clean and even the cut surface 70. The force of contact of skid plate 40 on cut surface 70 reacts to and supports the cutting forces of bucket chain 50. Movement of the skid plate 40 in response to the influence of variations of cut surface 70 is damped by right and left shock absorbers 52 and 53 which are connected from the main frame 22 to skid plate 40 coaxially with springs 48 and 49. Shock absorbers 52 and 53 are custom items based conventional automotive hydraulic designs, but made for much heavier duty. They are configured to allow downward displacement of skid plate 40 under the force of springs 48 and 49 with minimal damping resistance, but to impose heavy damping on upward movement thereof. This heavy damping augments spring force to provide reactive resistance to the shock loads encountered when excavating hard formations.

Figure 5:
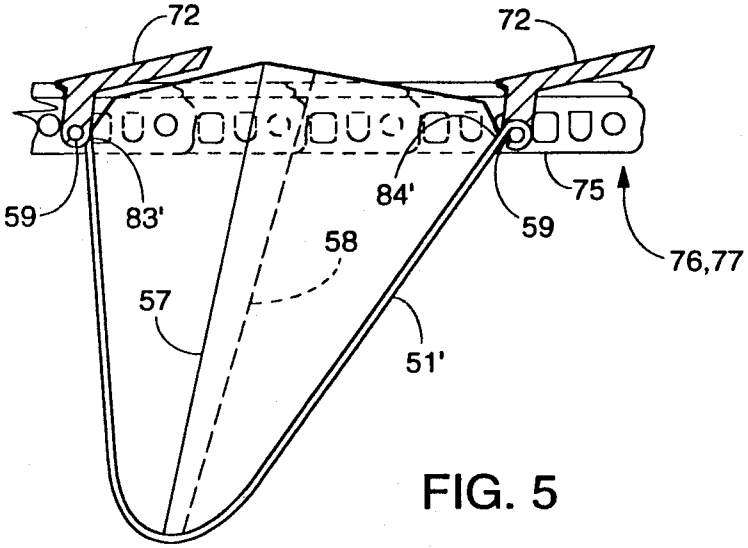
FIG. 5 shows an alternate configuration of a multi-pitch bucket as might be applied to the preferred embodiment of the invention.
Figure 6:
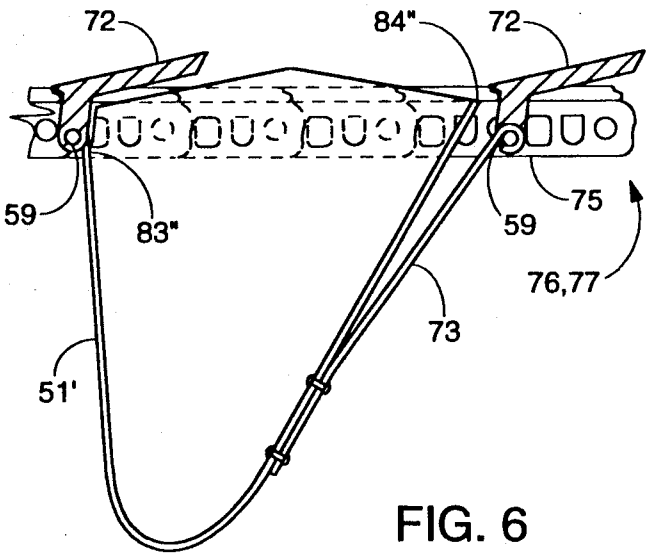
FIG. 6 shows a second alternate configuration of a multi-pitch bucket as might be applied to the preferred embodiment of the invention.
Figure 4:
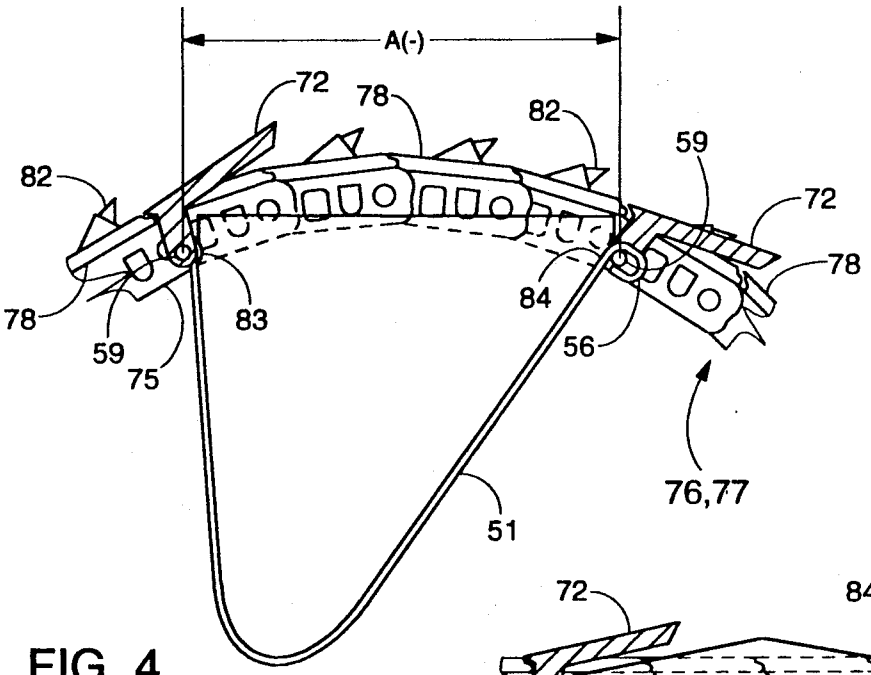
FIG. 4 shows a preferred configuration of a multi-pitch bucket as applied to the preferred embodiment of the invention.

Closely spaced bucket chain assemblies 50 include large capacity, multiple pitch buckets 51 which are adapted to accommodate the changing chordal dimensions while passing through straight runs, and around the upper driving sprockets 60 and lower digging sprockets 61, as indicated by the dimension A of FIGS. 4 and 5. This can be accomplished by the open pin connection loop 56 of the preferred bucket embodiment 51 as shown in FIG. 4; by the split and overlapping side walls 57 and 58 of the alternate bucket embodiment 51' shown in FIG. 5; or by the flexible hinge member 73 of the second alternate bucket embodiment 51" as shown in FIG. 6. The bucket chain assemblies 50 comprise spaced cutting bars 72 which span the width of buckets 51, serving to dig formation material and urge it into buckets 51. Bucket attachment hinge pins 59 join hinged bucket leading edges 84, 84' or 84 " and hinged bucket trailing edges 83, 83' or 83" to adjacent cutting bars 72 which in turn are affixed at either end to links 75 of right and left digging chains 76 and 77. These digging chain links 75 are commercially available from Caterpillar Industrial Products, Inc. of Peoria, Ill., as their No. 4C2488, for use as crawler tracks components.

Chain links 75 interspaced between those supporting cutting bars 72 in digging chains 76 and 77 are protected from contact with the work face by bar segments 78, as is also shown in FIG. 3. Digging teeth 82 mounted in bar segments 78 cut material from the work face and urge it into the buckets 51.

Returning now to FIGS. 1 and 3, the digging sprockets 61, rotatably mounted on axle 21, are of sufficient diameter to provide rigid support to the bucket chain assemblies 50 along the depth of the work face. The peripheral section contour of digging sprockets 61, if not toothed, is the same as is used by Caterpillar and others for crawler track idlers. The driving sprockets 60 are positioned above and behind the digging sprockets 61 so that material is discharged outwardly by both gravitational and centrifugal forces as the buckets 51 pass over the driving sprockets 60. The center distance for digging sprockets 61 and driving sprockets 60 is adjusted to compensate for wear by means of wedge assemblies 54 which are drawn by adjusting screw 55 to bear against the angled faces 99 and 98 of right and left hand chain drive housing sections 65 and 66 which rotate about pivotal connections 65*a* and 66*a* to main frame 22.

Power input to the driving sprockets 60 may be accomplished by various other means, but in this embodiment, a pair of silent chains 62 run inside right and left chain drive housing sections 65 and 66 to drive the sprocket shaft 63 on which driving sprockets 60 and silent chain output sprockets 64 are mounted. The silent chains 62 are tensioned by means of adjustable idlers 67. Power is supplied to silent chain input sprockets 68 by hydraulic motors 69 through right angle planetary gear reducers 71 thus placing the component mass for driving bucket chain assemblies 50 rearward on system 20.

Material excavated by bucket chain assemblies 50 is discharged onto right and left transverse conveyors 38 and 39 respectively, and onto central conveyor 26 to be conveyed to elevated rear transfer conveyor 27.

Figure 7:
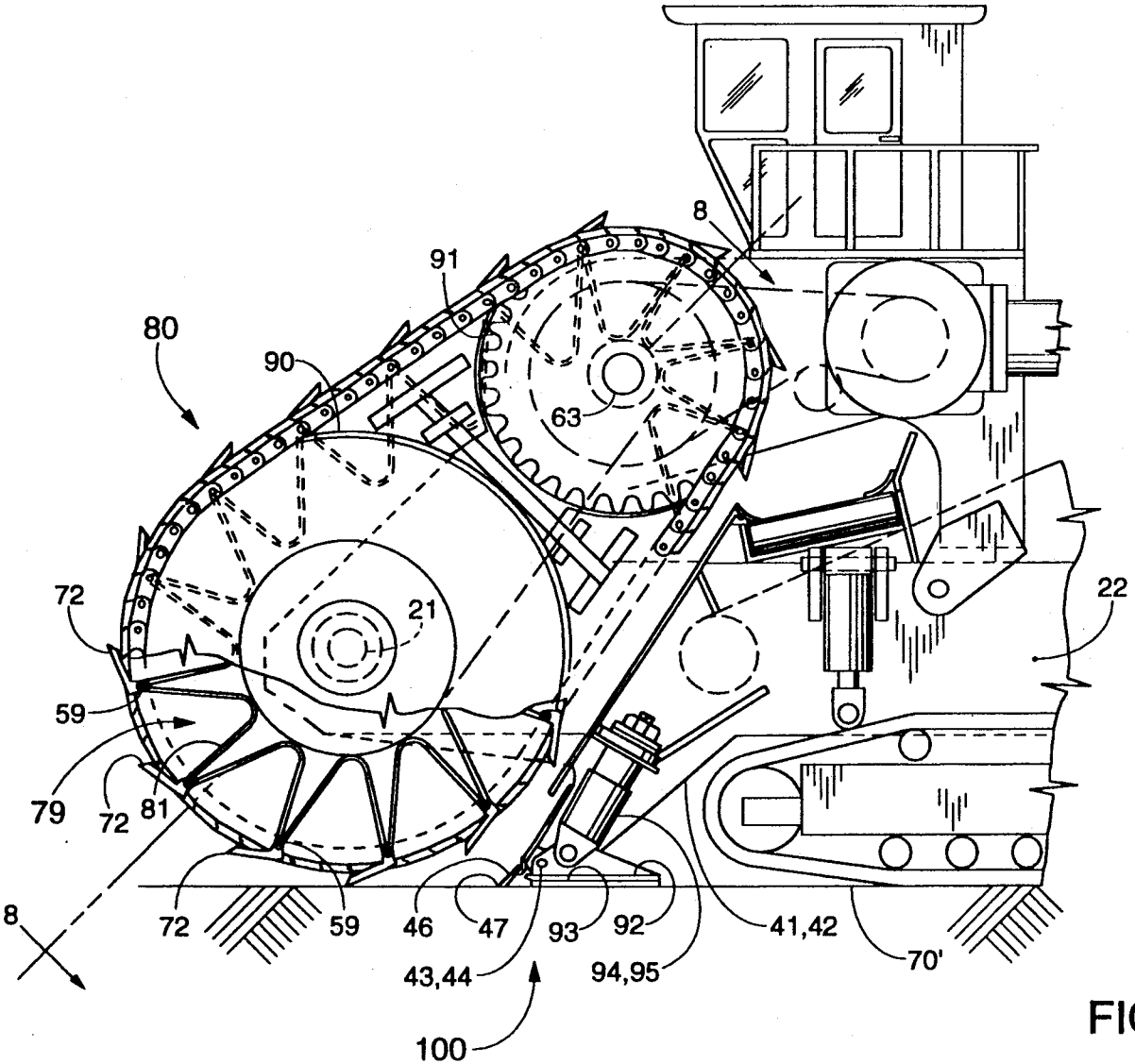
FIG. 7 shows a detailed side view of an alternate embodiment of the invention with rotating side walls and fixed side boards acting as bucket end walls.
Figure 8:
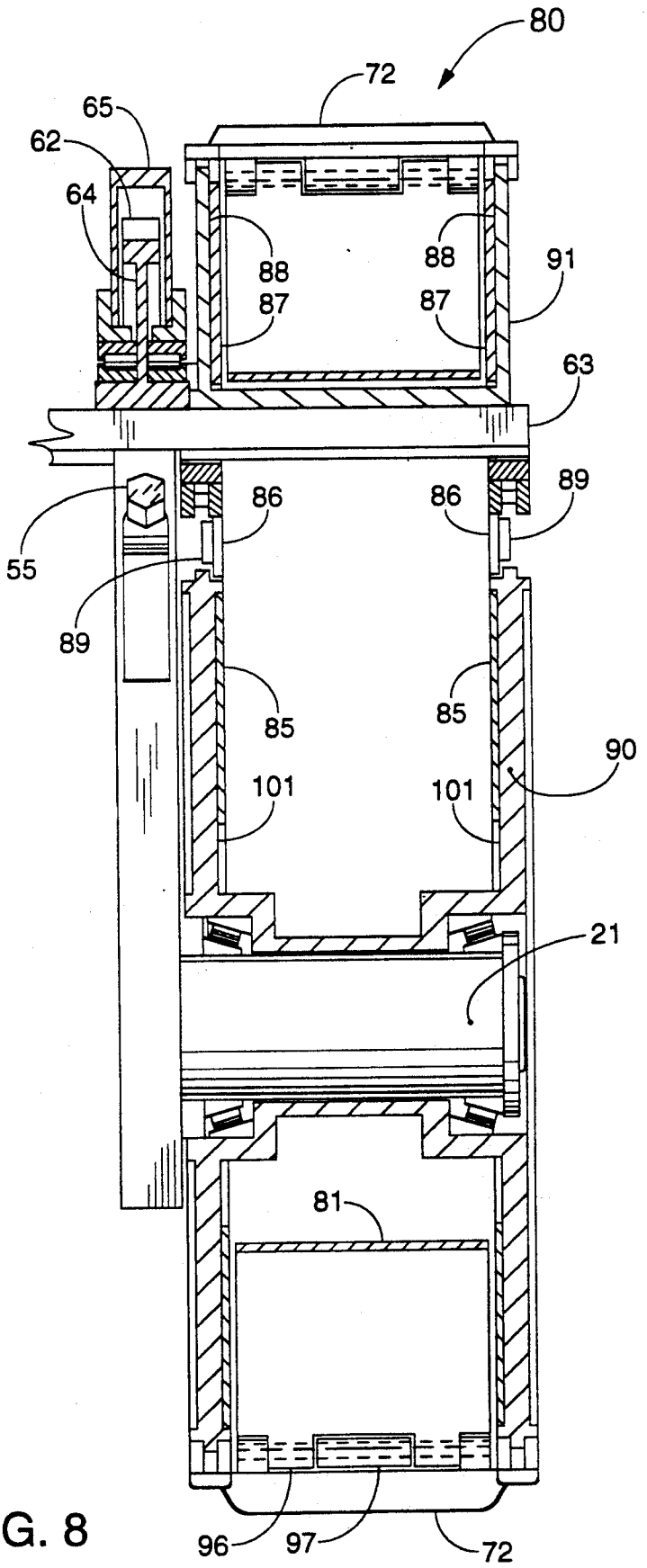
FIG. 8 shows a section view of a single bucket chain assembly taken along line 8—8 of FIG. 7.

FIG. 7 discloses an alternate embodiment of the present invention wherein digging sprockets 90 rotate on axle 21 and driving sprockets 91 are mounted on sprocket shaft 63. FIG. 8 is taken along line 8—8 of FIG. 7 and, in every respect not specifically mentioned, the configuration of this embodiment is as that of FIG. 1. Buckets 79 of bucket chain assemblies 80 comprise only a transverse wall 81, attached to adjacent cutting bars 72 at the hinged leading bucket edge 97 and hinged trailing bucket edge 96 by bucket attachment hinge pins 59. Chordal dimension variations, in this case, are accommodated by flexing of transverse wall 81. The open side walls of buckets 79 are abutted by abrasion resistant plastic side plate sections 85, 86 and 87. These parts are flat pieces of commercially available UHMW-819 polyethylene bonded to the appropriate steel section. Digging sprockets side plate sections 85 are bonded to the inner faces 101 of digging sprockets 90; sprocket side plate sections 87 are bonded to inner faces 88 of drive sprockets 91. Fixed side sections 86 are similarly attached to side boards 89 to serve as bucket side walls through the straight run of bucket chain assemblies 80.

Right and left moldboard bolsters 41 and 42 extend from main frame 22 and support moldboard assembly 100 with moldboard blade 46 and cutting edge 47 in a single working position as previously shown in FIG. 1. Skid plate 92, including bonded, frictional drag reducing UHMW-819 facing 93, is likewise mounted by the pivotal connections 43 an 44. In this alternative embodiment, however, skid plate 92 is urged into contact with the underlying cut surface 70' by right and left liquid spring units 94 and 95, commercially available from Taylor Devices, Inc. of North Tonawanda, N.Y. These units are made generally in accordance with U.S. Pat. No. 4,064,977, and afford both the required spring contact force and damping characteristics. The force of contact reacts against cut surface 70' so as to support the cutting forces of the bucket chains 80, with heavily damped compressive response to shock loading and lightly damped extension movement of the skid plate 92.

Figure 9:
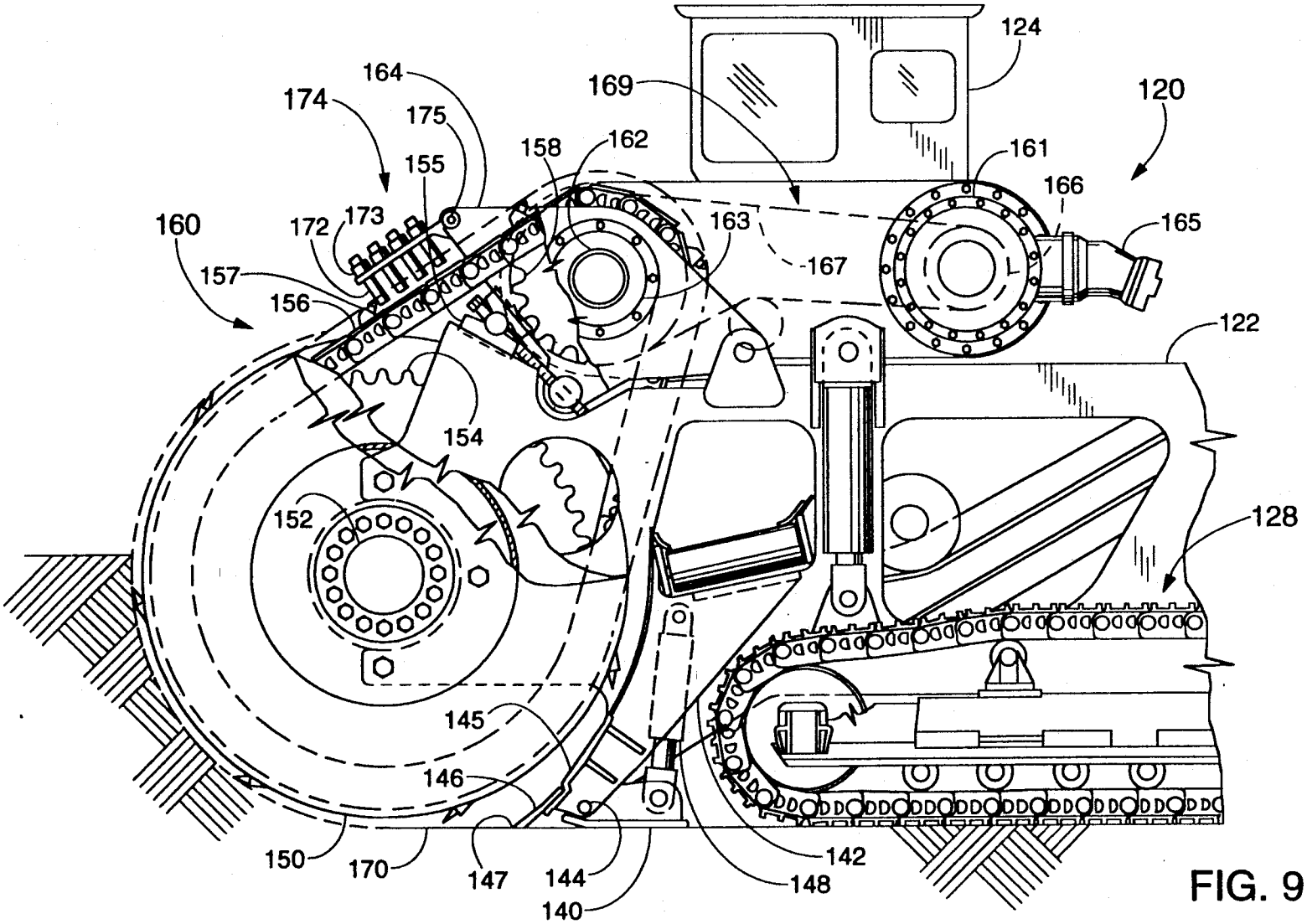
FIG. 9 shows a side view of an alternate embodiment wherein a digging chain is utilized to drive the bucket wheel, and, FIG. 10 shows a plan view of the embodiment of FIG. 9.
Figure 10:
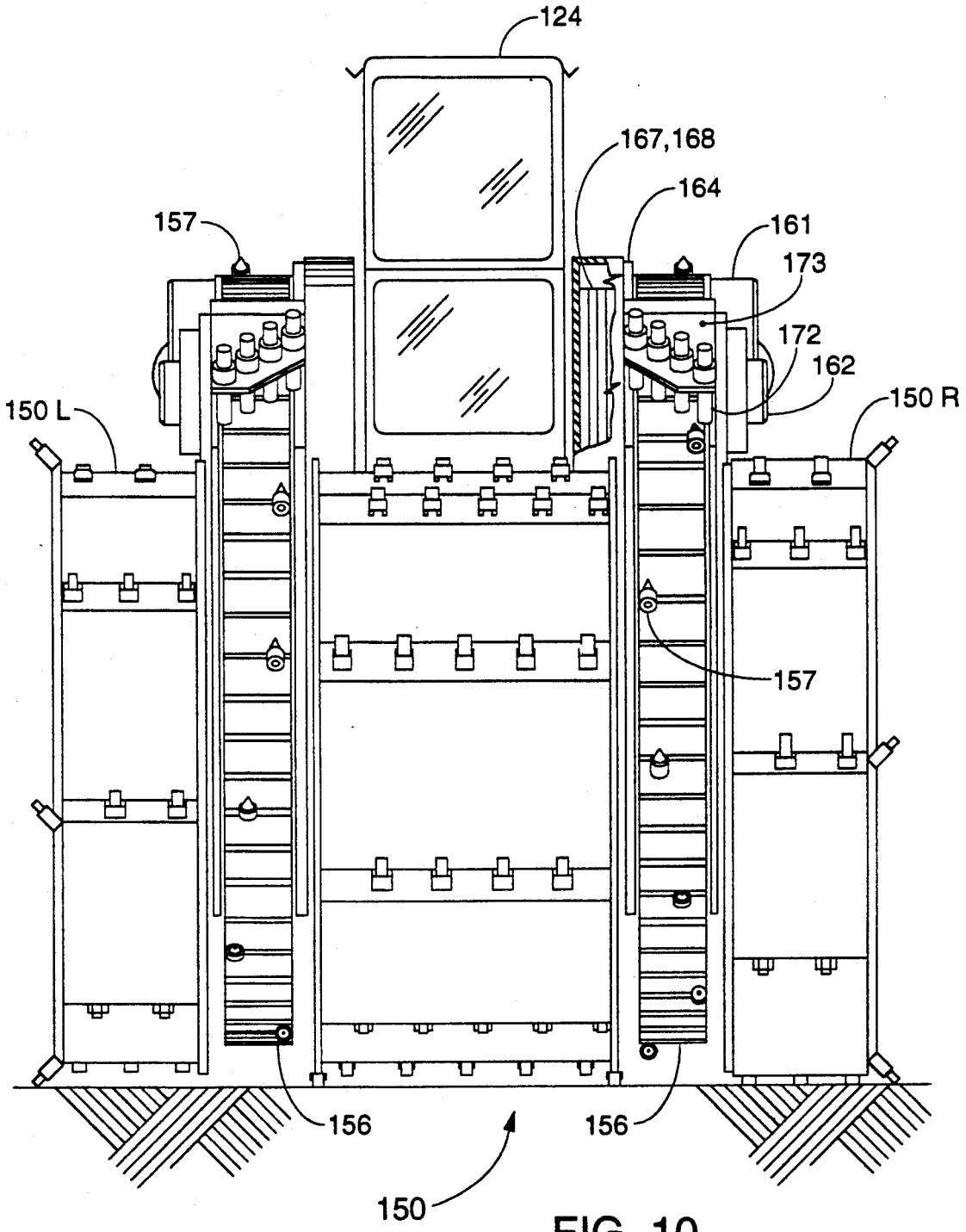

Turning now to FIGS. 9 and 10, therein is shown an alternate excavating system embodiment 120 incorporating the present invention. The system 120 comprises a vehicle main frame 122 with operator cab 124 mounted thereon and bucket wheel assembly 150 mounted to the front end thereof. System 120 is supported and moves on crawler track undercarriage 128 within the width excavated by bucket wheel assembly 150. Undercarriage 128 is attached to the main frame 122 for vertical movement in the manner as previously described for system 20.

Moldboard bolsters 142 extend down from each side of main frame 122 to support moldboard assembly 145 with moldboard blade 146 and cutting edge 147. Skid plate 140 is mounted to the lower end of bolsters 142 by pivotal connections 144 and is urged into contact with excavated surface 170 by means of hydraulic cylinder/-shock absorbers 148. Travel of skid plate 140 is sufficient to maintain contact with surface 170 under all conditions of up and down grade transitions, and to allow for compaction of the underlying material. The moldboard blade 146 serves to trim material not cut by bucket wheel assembly 150 and to even, smooth and clean surface 170. The force of contact of skid plate 140 on surface 170 reacts to, and supports the cutting forces of bucket chain assemblies 150 in normal operation. The hydraulic cylinder/shock absorbers 148 are configured to allow downward displacement of skid plate 140 under the force of hydraulic pressure with minimal damping resistance, but to impose heavy damping on upward displacement. This heavy damping augments hydraulic pressure to provide reactive resistance to shock loads as encountered when excavating hard formations. Bucket wheel assembly 150 which includes cantilevered assembly sections 150L and 150R is driven to rotate on transverse axle located at the forward end of main frame 122 152 by inboard digging chain assembly 160. Each digging chain assembly 160 includes digging sprocket 154, digging chain 156 and upper driving sprocket 158. Upper driving sprocket 158 is carried on upper shaft 162 which rotates on bearings 163 in housing 164 and tension is adjusted by means of wedge and screw assembly 155. Upper shaft 162 is powered for rotation by hydraulic motor 165, driving through gear reducer 167 and high speed chain assembly 169. Chain assembly 169 comprises input sprocket 166, drive chain 167 and output sprocket 168 mounted on upper shaft 162 coaxially with upper driving sprocket 158. Material dug from the central portion of the excavated path and elevated by digging chain 156 is brushed into the bucket wheel assembly 150 by deflectors 174 which are pivotally attached by connecting pins 175. Deflectors 174 comprise hinge plates 173 carrying round rubber brush elements 172 in an inclined row, positioned to deflect material toward the center of bucket wheel assembly 150. The rubber elements 172 are readily deflected by digging teeth 157 as digging chain assembly rotates.

Although particular embodiments of the invention are shown in the accompanying Drawings and described in the foregoing Detailed Description, it will be understood that the present invention is not limited to the embodiments disclosed, but is capable of rearrangement, modification and substitution of parts and elements without departing from the spirit and scope of the invention as defined in the appended claims.

I claim:

1. An excavating and loading machine comprising:
a main frame having forward and rearward ends;
undercarriage means having forward and rearward movement capability for supporting said main frame;
an axle rigidly supported at the forward end of said main frame;
a plurality of endless excavating chain assemblies having a series of adjacent buckets, each comprising a cutting edge, transverse walls, side walls and means for expansibly spanning a chordal dimension of multiple chain pitches;
digging sprocket means rotatably mounted cantilever on said axle for supporting at least two said excavating chain assemblies so that the excavation made thereby is wider than the width of said undercarriage;
upper sprocket means for engaging and driving said excavating chain assemblies so that said cutting edges excavate material in advance of said machine and so that said buckets carry the excavated material upwardly and are inverted when passing thereover so as to discharge said material;
drive means for rotating said upper sprockets;
smoothing means located between said excavating chain assemblies and said undercarriage for cleaning and evening the surface cut by said excavating chain assemblies;
conveyor means located entirely behind said excavating chain assemblies for taking away material discharged from buckets inverted in passing over said upper sprocket means and conveying said material rearwardly to a material delivery position; and
adjustment means for raising and lowering said axle relative to said undercarriage so as to position said excavating chains relative to the material being excavated.

2. An excavating and loading system according to claim 1 wherein said digging sprocket is of a diameter at least equal to the full depth of said excavation.

3. An excavating and loading system according to claim 1 wherein
said smoothing means comprises;
a transverse moldboard connected to said main frame, between said bucket chain and said undercarriage, for urging passed material into said bucket chains;
a blade edge on said moldboard to clean and even the surface cut by said bucket chains; and
skid plate means between said blade edge and said undercarriage for bearing on said cut surface so as to support excavating chain cutting forces.

4. An excavating and loading system according to claim 3 wherein
said skid plate means further comprises:
a skid plate pivotally connected to said moldboard adjacent said blade edge;
substantially constant force means for urging said skid plate down against said cut surface; and
damping means for limiting the upward rate of displacement of said skid plate in response to said cutting forces.

5. An excavating and loading system according to claim 4 wherein said substantially constant force means comprises a liquid spring.

6. An excavating and loading system according to claim 4 wherein said substantially constant force means comprises a mechanical spring.

7. An excavating and loading system according to claim 4 wherein said damping means comprises a hydraulic shock absorber.

8. An excavating and loading system according to claim 4 wherein said damping means comprises a liquid spring.

9. An excavating and loading machine comprising:
a main frame having forward and rearward ends;
undercarriage means with forward and rearward movement capability for supporting said main frame;
an axle rigidly supported at the forward end of said main frame;
a plurality of endless excavating chain assemblies having a series of adjacent buckets, each comprising a cutting edge and a transverse wall, and expansibly spanning the chordal dimension of multiple chain pitches;
digging sprocket means rotatably mounted cantilever on said axle for supporting two said excavating chain assemblies so that the excavation made thereby is wider than the width of said undercarriage;
upper sprocket means for engaging and driving said excavating chain assemblies so that said cutting edges excavate material in advance of said machine and so that said buckets carry the excavated material upwardly and are inverted when passing thereover so as to discharge said material;
said upper sprocket means including bucket side wall means for abutting said transverse bucket walls engaged therewith so as to contain excavated material;
said digging sprocket means including bucket side wall means for abutting said transverse bucket walls engaged therewith so as to contain excavated material;
stationary side wall means for abutting said transverse bucket walls between said upper and digging sprockets so as to contain excavated material;
drive means for rotating said sprockets;
smoothing means located between said excavating chain assemblies and said undercarriage for cleaning and evening the surface cut by said excavating chain assemblies;
conveyor means located entirely behind said excavating chain assemblies for taking away material discharged from buckets inverted in passing over said upper sprocket means and conveying said material rearwardly to a material delivery position; and
adjustment means for raising and lowering said axle relative to said undercarriage so as to position said excavating chain assemblies relative to the material being excavated.

10. An excavating and loading system according to claim 9 wherein said digging sprocket is of a diameter at least equal to the full depth of said excavation.

11. An excavating and loading system according to claim 9 wherein said smoothing means comprises;
a transverse moldboard connected to said main frame, between said bucket chain and said undercarriage, so as to urge passed material into said bucket chains;
a blade edge on said moldboard to clean and even the surface cut by said bucket chains; and skid plate means between said blade edge and said undercarriage for bearing on said cut surface so as to support excavating chain cutting forces.

12. An excavating and loading system according to claim 11 wherein said skid plate means further comprises;

a skid plate pivotally connected to said moldboard adjacent said blade edge;

substantially constant force means for urging said skid plate down against said cut surface; and skid plate in response to said cutting forces.

13. An excavating and loading system according to claim 12 wherein said substantially constant force means comprises a liquid spring.

14. An excavating and loading system to claim 12 wherein said substantially constant force means comprises a mechanical spring.

15. An excavating and loading system to claim 12 wherein said damping means comprises a hydraulic shock absorber.

16. An excavating and loading system to claim 12 wherein said damping means comprises a liquid spring.

17. A bucket chain assembly for continuously excavating, elevating and discharging material comprising:

a supporting structure having first and second sections wherein said first section is over said second section;

a first and second shaft parallelly mounted in said first and second sections respectively;

two first chain sprockets rotatably mounted on said first shaft in a fixed, spaced apart relationship;

two second chain sprockets rotatably mounted on said second shaft, each in alignment with one said first sprocket;

two like endless chains having a multiplicity of pitches, each being engaged with an aligned first and second sprocket for movement around a pitchline path thereabout;

a continuous array of adjacent bucket means for excavating and elevating material, carried between said endless chains and spanning connections thereto at locations separated by a plurality of chain pitches; and drive means for rotating said sprockets and moving said chains around their pitchline paths so that said bucket means excavate and carry material upwardly and are inverted in passing said first sprockets to discharge said material, and wherein said bucket means further comprises means to vary differences between chordal and pitchline path dimensions while moving around said first and second sprockets.

18. A bucket chain assembly for continuously excavating, elevating and discharging material in accordance with claim 17 wherein said adjacent bucket means comprise:

a plurality of uniformly spaced apart cutting bars, spanning the space between said endless chains and fixedly attached to non-adjacent chain links on the outer periphery of both said endless chains so as to be perpendicular to the pitchline paths thereof;

a plurality of formed transverse wall members spanning the space between adjacent cutting bars, each hingedly attached to both said cutting bars so that said wall members extend within the periphery of said endless chains and define the capacity of said bucket means; and bucket side wall means for containing said capacity.

19. A bucket chain assembly for continuously excavating, elevating and discharging material in accordance with claim 17 wherein said adjacent bucket means comprise:

a plurality of uniformly spaced apart cutting bars, spanning the space between said endless chains and fixedly attached to non-adjacent chain links on the outer periphery of both said endless chains so as to be perpendicular to the pitchline paths thereof;

a plurality of formed transverse wall members spanning the space between adjacent cutting bars, each hingedly attached to both said cutting bars so that said wall members extend within the periphery of said endless chains and define the capacity of said bucket means;

said first sprockets including bucket side wall means for abutting said transverse wall members where adjacent thereto, so as to contain said capacity;

said second sprockets including bucket side wall means for abutting said transverse wall members where adjacent thereto, so as to contain said capacity; and said supporting structure including stationary side wall means for abutting said transverse wall members between said first and second sprockets so as to contain material being elevated within said capacity.

20. A machine for excavating, elevating and loading material comprising:

a main frame having forward and rearward ends;

undercarriage means having forward and rearward movement capability for supporting said main frame;

a transverse axle rigidly located with respect to said main frame at the forward end thereof;

rotating means mounted on said axle so as to extend cantilever wider than any other part of said machine for excavating and for discharging excavated material rearwardly at an elevated position;

chain drive means mounted inwardly on said axle for driving said rotating means and for digging and elevating a portion of the width of a path so that said rotating means and said chain drive means together dig a path wider than any other part of said machine;

conveyor means located behind said rotating means for receiving and taking away all material excavated by said chain drive means and said rotating means and conveying said material rearwardly to a material delivery position; and adjustment means for raising and lowering said rotating means relative to said undercarriage.

21. An excavating and loading machine comprising:

a main frame having forward and rearward ends;

undercarriage means having forward and rearward movement capability for supporting said main frame;

an axle transversely supported at the forward end of said main frame and rigidly located with respect thereto;

a bucket wheel assembly mounted on said axle so that sections thereof extend cantilever beyond the width of any other part of said machine;

a bucket wheel drive sprocket mounted to said axle inwardly of said cantilever sections;

endless chain means engaging said bucket wheel drive sprocket, said chain means including peripheral digging elements for digging and excavating material;

means for driving said chain means so that said peripheral digging elements clear a path for the forward movement of said chain means and rotate said bucket wheel assembly so as to excavate a path wider than any other part of said machine;

smoothing means located between said bucket wheel assembly and said undercarriage for cleaning and evening the surface cut by said bucket wheel assembly and said chain means;

conveyor means located behind said bucket wheel assembly for taking away excavated material and conveying said material rearwardly to a material delivery position; and adjustment means for raising and lowering said axle relative to said undercarriage so as to position said bucket wheel assembly relative to the material being excavated.

22. An excavating and loading system according to claim 21 wherein said smoothing means comprises;

a transverse moldboard connected to said main frame, between said bucket wheel assembly and said undercarriage, for urging passed material into said bucket wheel assembly;

a blade edge on said moldboard to clean and even the surface cut by said bucket wheel assembly and said chain; and skid plate means between said blade edge and said undercarriage for bearing on said surface so as to support bucket excavating forces.

23. An excavating and loading system according to claim 22 wherein said skid plate means further comprises:

a skid plate pivotally connected to said moldboard adjacent said blade edge;

substantially constant force means for urging said skid plate down against said cut surface; and damping means for limiting the upward rate of displacement of said skid plate in response to said cutting forces.

24. An excavating and loading machine comprising:

a main frame having forward and rearward ends;

undercarriage means with forward and rearward movement capability for supporting said main frame;

two support members extending forwardly from said main frame;

an axle transversely and rigidly located by said support members;

an outer bucket wheel mounted cantilever on said axle on each side of said machine;

an inner bucket wheel mounted on said axle between said support members so that each said support member is situated in the space between said inner and outer bucket wheels;

a bucket wheel drive sprocket mounted to said axle within said space;

an endless chain engaging said bucket wheel drive sprocket, said chain including peripheral digging elements for digging and elevating material;

means for driving said chain so that said peripheral digging elements clear a path between said inner and outer bucket wheels and rotate said bucket wheels so as to excavate a path wider overall than any other part of said machine; and adjustment means for raising and lowering said axle relative to said undercarriage.

25. An excavating and loading machine in accordance with claim 24 and further comprising:

smoothing means located between said bucket wheel assembly and said undercarriage for cleaning and evening the surface cut by said bucket wheel assembly and said chain; and conveyor means located entirely behind said bucket wheel assembly for taking away excavated material and conveying said material rearwardly to a material delivery position.

26. A method for digging a trench which comprises:

positioning rotary digging means cantilever to dig and elevate the outer portions of the trench to a width wide enough to pass any part of the excavating machine;

driving the rotary digging means with a digging chain which digs and elevates a central portion of the width of the trench;

co-axially positioning second rotary digging means to dig the remaining central portion of the trench;

evening the bottom of the trench after digging;

advancing the excavating machine along the cut bottom of the trench;

urging the material dislodged by evening forward to be picked and elevated;

discharging all elevated materials onto a conveyor; and conveying the discharged materials away from the trench.

* * * * *